US006564952B1

(12) United States Patent
Suttles

(10) Patent No.: US 6,564,952 B1
(45) Date of Patent: May 20, 2003

(54) MERCHANDISING DISPLAY

(75) Inventor: J. Marshall Suttles, Elberton, GA (US)

(73) Assignee: Royston, LLC, Jasper, GA (US)

( * ) Notice: Subject to any disclaimer, the term of this patent is extended or adjusted under 35 U.S.C. 154(b) by 0 days.

(21) Appl. No.: 09/989,478

(22) Filed: Nov. 19, 2001

(51) Int. Cl.[7] ..... A47B 43/00
(52) U.S. Cl. ..... 211/187
(58) Field of Search ..... 211/181.1, 85.31, 211/90.03, 106, 119, 126.9, 187; 108/108, 109

(56) References Cited

U.S. PATENT DOCUMENTS 3,003,644 A * 10/1961 Hildebrand ..... 211/74
4,558,647 A * 12/1985 Petersen ..... 108/107
4,632,260 A 12/1986 Hart et al.
4,702,380 A * 10/1987 Herman ..... 211/57.1
4,825,601 A 5/1989 Halverson
4,884,702 A * 12/1989 Rekow ..... 211/90.02
4,891,897 A 1/1990 Gieske et al.
5,241,796 A 9/1993 Hellwig et al.
5,482,168 A * 1/1996 Welch et al. ..... 211/106
5,857,578 A 1/1999 Fishman
5,918,750 A * 7/1999 Jackson ..... 211/189
6,062,402 A * 5/2000 Ford ..... 211/189
6,299,001 B1 * 10/2001 Frolov et al. ..... 211/106

* cited by examiner

*Primary Examiner*—Alvin Chin-Shue
*Assistant Examiner*—Sarah Purol
(74) *Attorney, Agent, or Firm*—Howson and Howson

(57) ABSTRACT

A merchandising display has a first set of vertical wires, a second set of horizontal wires and a plurality of elongated panels. The vertical wires are disposed in parallel, spaced relationship to one another. The horizontal wires are disposed in parallel, adjacent pairs, the wires of each pair being spaced from each other by a distance greater than the spacing between adjacent pairs. The horizontal wires are connected to the first set of wires by resistance welds. Each panel has long edges which extend in the direction of elongation of the panel, and flanges which extend rearward from the edges. The panels are capable of snap-fit engagement with the pairs of horizontal wires to achieve either a closed slat wall appearance or a dual open/closed appearance. Access slots are formed between adjacent panels for receiving brackets of merchandise supports such as rods or shelves.

9 Claims, 5 Drawing Sheets

44
52
34
46
36
48
34
50
42
42

*Fig. 6*
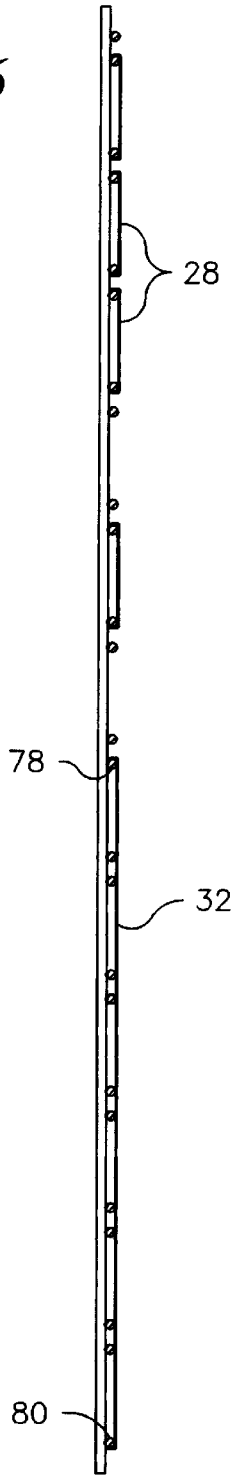
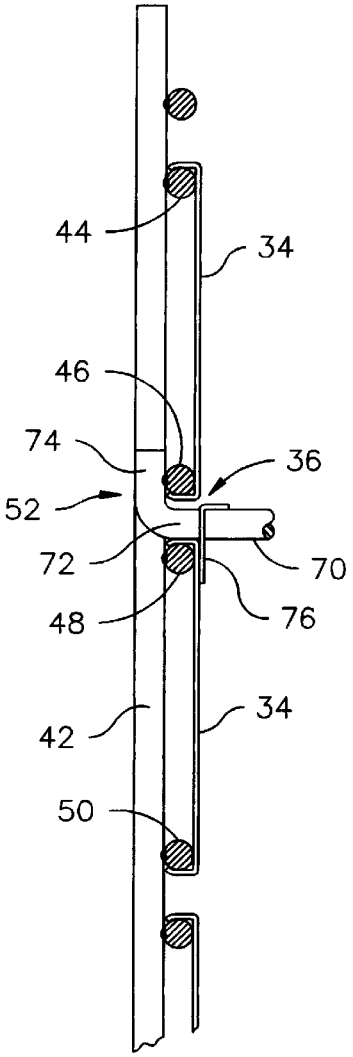
*Fig. 5*
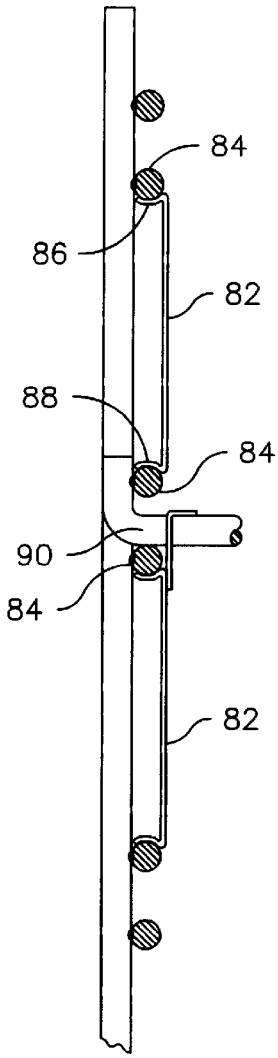
*Fig. 7*

MERCHANDISING DISPLAY

FIELD OF THE INVENTION

This invention relates to merchandising displays, and more particularly to a merchandising display in which merchandise is supported on rods, shelves, hangers or similar supports which are removably attached to a wall or wall-like support.

BACKGROUND OF THE INVENTION

One known merchandising display utilizes an open grid back panel. Typical open grid back panels include a plurality of horizontal crossbars or wire rods fixed to an array of laterally spaced vertical supports. Display accessories such as merchandise support rods and shelves can be hung from the horizontal crossbars for supporting and displaying merchandise. However, the appearance of open grid displays is such that they are not suitable for some applications.

Another known merchandising display utilizes a closed slat wall back panel. Typical slat wall displays include wood, plastic or metal slats as structural members. The slats are spaced from one another to provide horizontal slots into which display accessories can be inserted. Although slat wall displays are generally more attractive in appearance than displays utilizing a open grid back panels, slat wall displays are not entirely satisfactory because the slats are expensive to produce and displays utilizing slats are difficult to assemble and take apart.

Another problem with current merchandising displays is their lack of versatility. For example, retailers who currently utilize a combination of open grid and slat wall displays in the presentation of their merchandise cannot change the proportion of open grid and slat wall displays unless they keep extras of each type of display on hand. Moreover, the retailer would need to have a large enough storage area in which to store the spare displays. Each of the foregoing problems causes the retailer to incur high capital expenditures. Additional expenditures may be incurred if the support rods and shelves used by the retailer are not compatible with both wire grid and slat wall displays.

SUMMARY OF THE INVENTION

It is an object of the invention to provide a merchandising display that is capable of being converted easily from an open grid-type display to a slat wall display; to provide a display which is strong yet structurally simple, utilizing a minimum number of different parts; to minimize or eliminate the need to store spare displays; to minimize the number of merchandise hangers, rods and shelves that need to be stored as auxiliary parts; and to provide a display which has a clean and pleasing appearance.

For the purpose of this description, the portion of a shelf, rod, hanger or like merchandise support, which engages with a grid or slat wall will be referred to as a "bracket."

The merchandising display in accordance with the invention comprises two sets of wires and a plurality of elongated panels. The wires of the first set are typically vertical wires, disposed in parallel, spaced relationship to one another. Each wire of the first set has a front side situated in an imaginary surface, usually a vertical plane. The wires of the second set are typically horizontal wires, disposed in parallel, spaced relationship to one another. Each wire of the second set has a rear side situated in the imaginary surface, and is connected to, and supported by, the wires of the first set to provide a grid-like array in which the wires of the second set are disposed in orthogonal relationship to the wires of the first set. The wires of the second set are further disposed in adjacent pairs, the wires of each pair being spaced from each other by a distance greater than the spacing between adjacent pairs.

Each elongated panel has a front face, a rear face, opposite long edges extending in the direction of elongation of the panel, and flanges which extend rearward from the long edges. The flanges are removably engageable with wires of the second set, the flanges preferably allowing the panels to be snapped into place on the wires. Access slots are provided between adjacent panels for receiving merchandise support brackets. In this way, by affixing plural panels to the wire grid, with narrow access slots provided between adjacent panels, a closed, slotted appearance can be achieved. A dual open/closed appearance can be achieved using the panels to cover the spaces between selected pairs of horizontal wires, leaving some of the other horizontal wires exposed. Wider panels can be utilized to cover a larger area of the wire backing, including the space between the wires of one or more pairs and the space between one or more adjacent pairs.

The merchandising display in accordance with the invention is superior to conventional slat wall displays especially in that it can be assembled easily by snapping panels onto a pre-assembled wire grid, and in that it can be converted easily from an open grid display to a slat wall display, and vice versa, or used as a hybrid display. The merchandising display of the invention is also advantageous in its strength and simplicity, in its pleasing appearance, and in its ability to reduce, and in some cases eliminate, the need to store spare displays and display components.

Other objects, details and advantages of the invention will be apparent from the following detailed description when read in conjunction with the drawings.

BRIEF DESCRIPTION OF THE DRAWINGS

FIG. 5 is a sectional view of a portion of the merchandising display, showing how a bracket of a merchandise support is engaged with the wire and panel structure;

FIG. 6 is a sectional view of a merchandising display showing an alternative arrangement of panels; and FIG. 7 is a sectional view of a portion of a merchandising display, showing an alternative panel configuration.

DETAILED DESCRIPTION OF THE PREFERRED EMBODIMENTS

Figure 1:
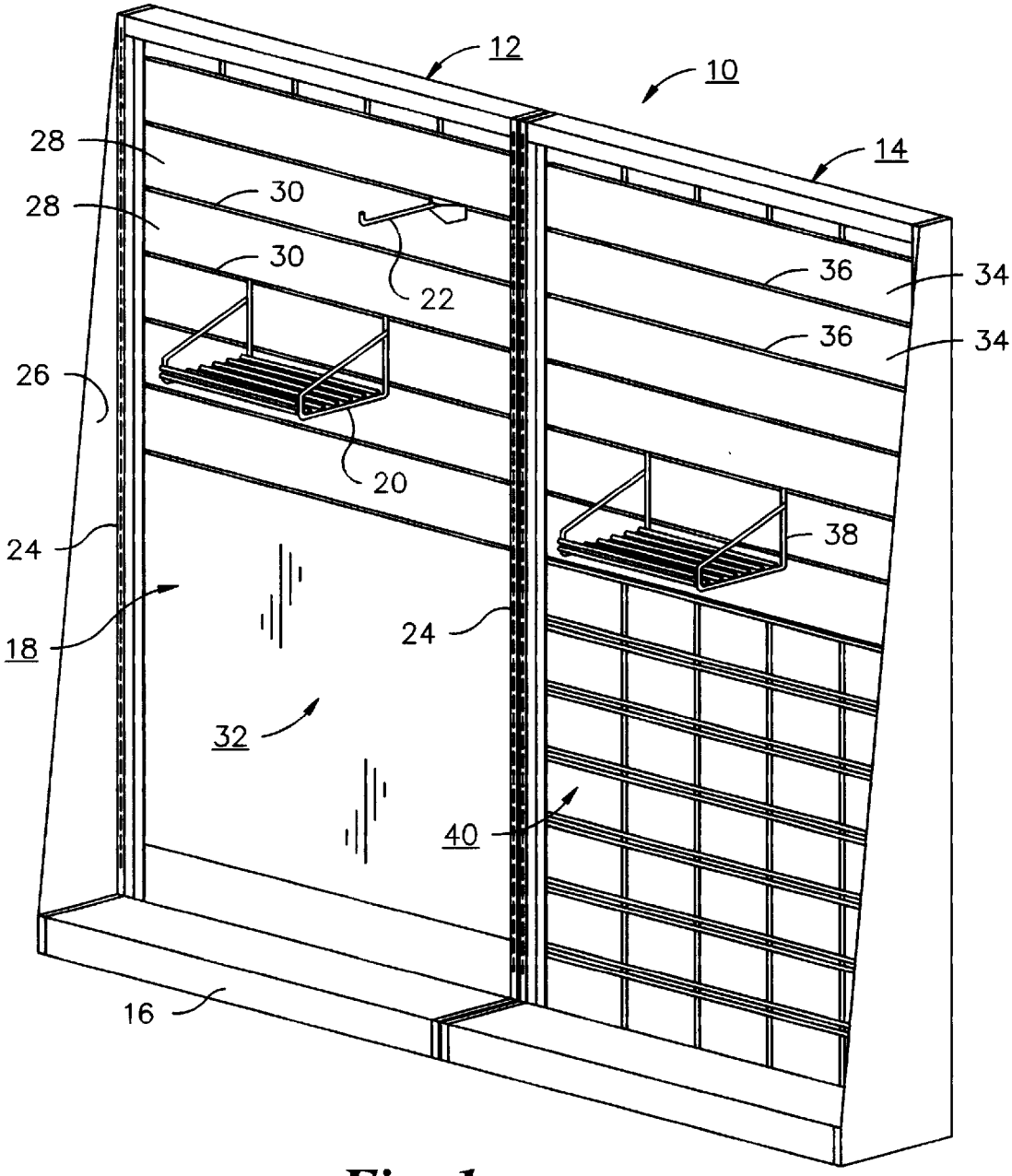
FIG. 1 is a perspective view showing the front of a typical merchandising display in accordance with the invention.

As shown in FIG. 1, a merchandising display 10 in accordance with the invention typically comprises several similar support units 12 and 14 arranged in side-by-side relationship. Unit 12 has a base 16 and a vertical part 18, the latter forming a wall on which various merchandise supports such as a wire shelf 20 or a rod 22 can be hung. For versatility, rigid posts 24 may be provided at both edges of the vertical part of each unit, each post having a vertical array of slots to which long shelves (not shown) can be attached. Because they are provided with bases, the units can be free-standing. Braces, such as brace 26 can be provided at one or both edges of the vertical part of each unit to improve structural strength and rigidity, and also to provide a barrier for use as a divider and for aesthetic purposes.

As shown in FIG. 1, the upper part of the vertical wall of unit 12 has a series of horizontally elongated panels 28, separated by narrow, horizontally extending slots 30 with which brackets of the shelf 20 and rod 22 are engaged. The lower part of the vertical wall is constituted by a large panel 32 and is not slotted.

The upper part of the vertical wall of unit 14 is constituted by a set of horizontally elongated panels 34 similar to panels 28, with slots 36 between them of receiving the brackets of various merchandise supports such as wire shelf 38. The lower part of the wall of unit 14 is an open wall consisting of an array 40 of vertical and horizontal wires. Shelves or other merchandise supports can be engaged with the horizontal wires in the same manner in which they are engaged in the slots between panels. As will be apparent from the following description, the array of wires, which is exposed at the lower part of unit 14, extends behind the panels 34 on the upper part of the unit, and a similar array of wires is provided behind the upper and lower panels of unit 12.

The support units may be simply situated in side-by-side relationship as shown in FIG. 1, or may be bolted together to prevent them from being moved. Various arrangements of the units are possible. For example, in many retail establishments, the units will be disposed in back-to-back relationship as aisle dividers, so that merchandise can be displayed on both sides.

Figure 2:
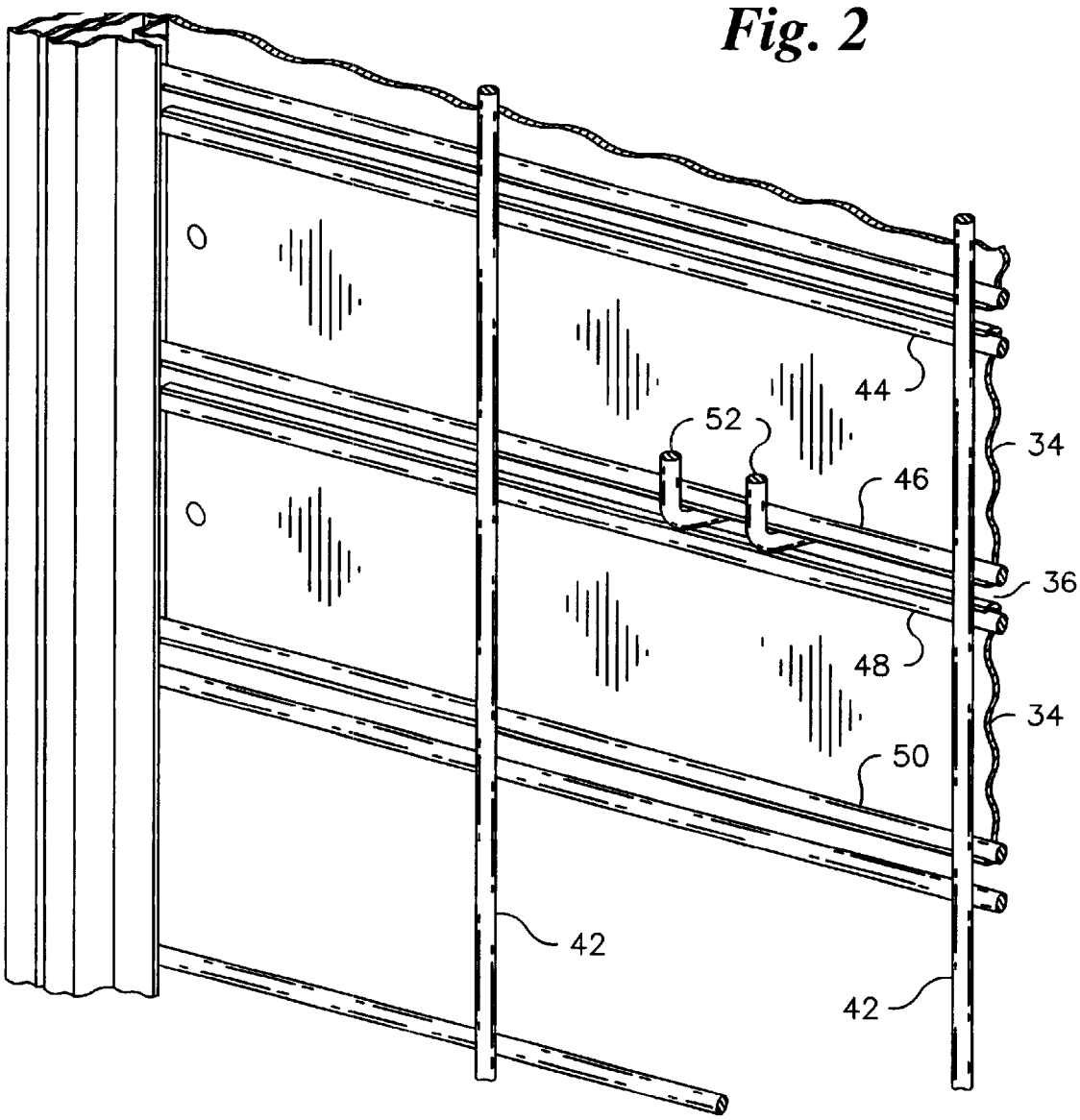
FIG. 2 is a fragmentary rear perspective view showing a portion of the merchandising display.

As shown in FIG. 2, the array of wires consists of a first set of vertical wires 42, and a second set of spaced, parallel horizontal wires. The horizontal wires, which are in transverse, orthogonal relationship with the wires 42 of the first set, are connected to the wires 42 by welds at their intersections so that the horizontal and vertical wires form a rigid grid, with the vertical wires supporting the horizontal wires. The horizontal wires are disposed in pairs, the wires of each pair being spaced from each other by a distance greater than the spacing between adjacent pairs. Thus, as shown in FIG. 2, a first pair of wires, consisting of wires 44 and 46, is located above a second pair of wires 48 and 50, and similar pairs of wires are provided respectively above wire 44 and below wire 50. The spacing between the wires of each pair is uniform, and larger than the spacing between adjacent pairs. That is, the spacing between wires 44 and 46 is the same as the spacing between wires 48 and 50, but much larger than the spacing between wires 46 and 48. A horizontally elongated panel 34 is engaged with the wires of each pair, but a slot 36 is provided between adjacent panels to receive hooks 52 of a bracket (not shown), which may be a bracket of a shelf such as shelf 38 (FIG. 1) or merchandise support rod 22 (FIG. 1).

Figure 3:
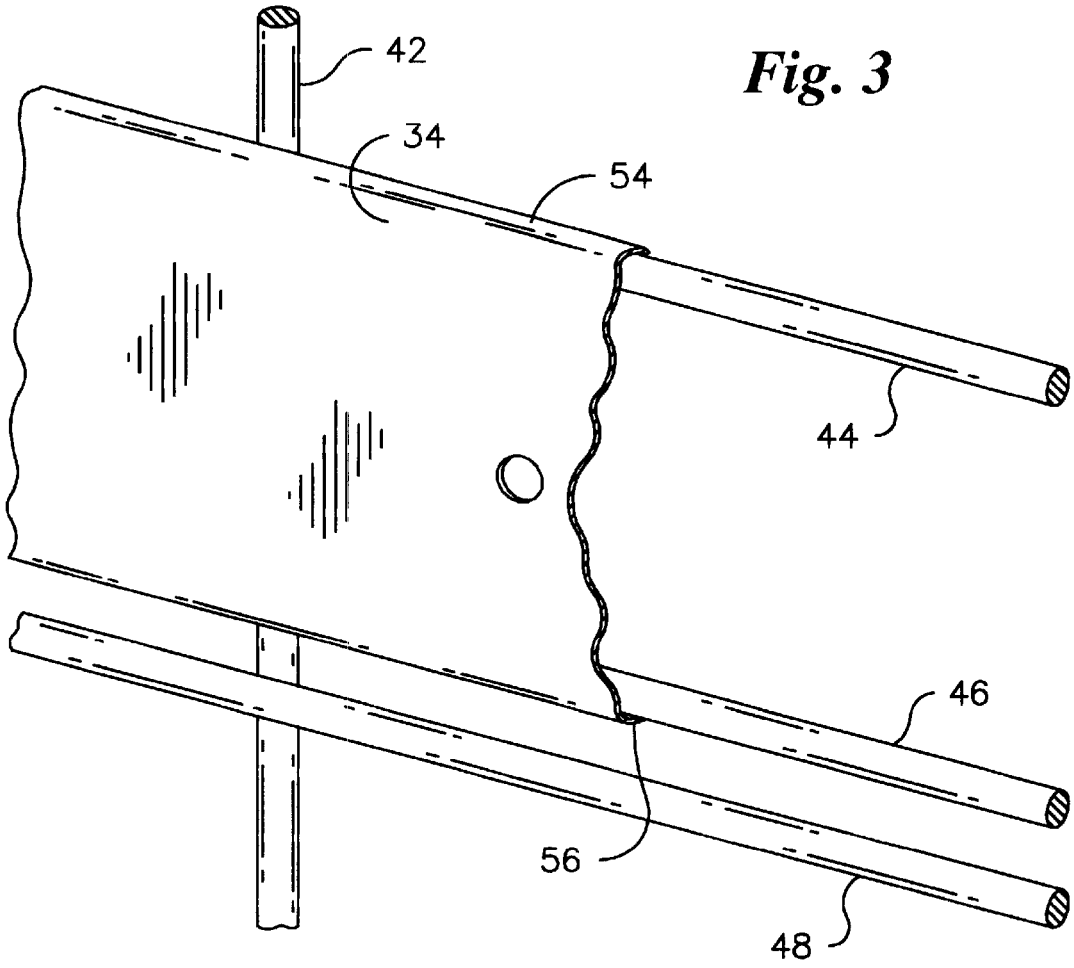
FIG. 3 is a fragmentary perspective view of the front of a merchandising display, showing a panel, partially cut away and engaged with a pair of horizontal wires.

As shown in FIG. 3, panel 34 has upper and lower flanges which embrace the pair of wires 44 and 46. The upper flange 54 engages the top of wire 44 and the lower flange 56 engages the bottom of wire 46.

Figure 4:
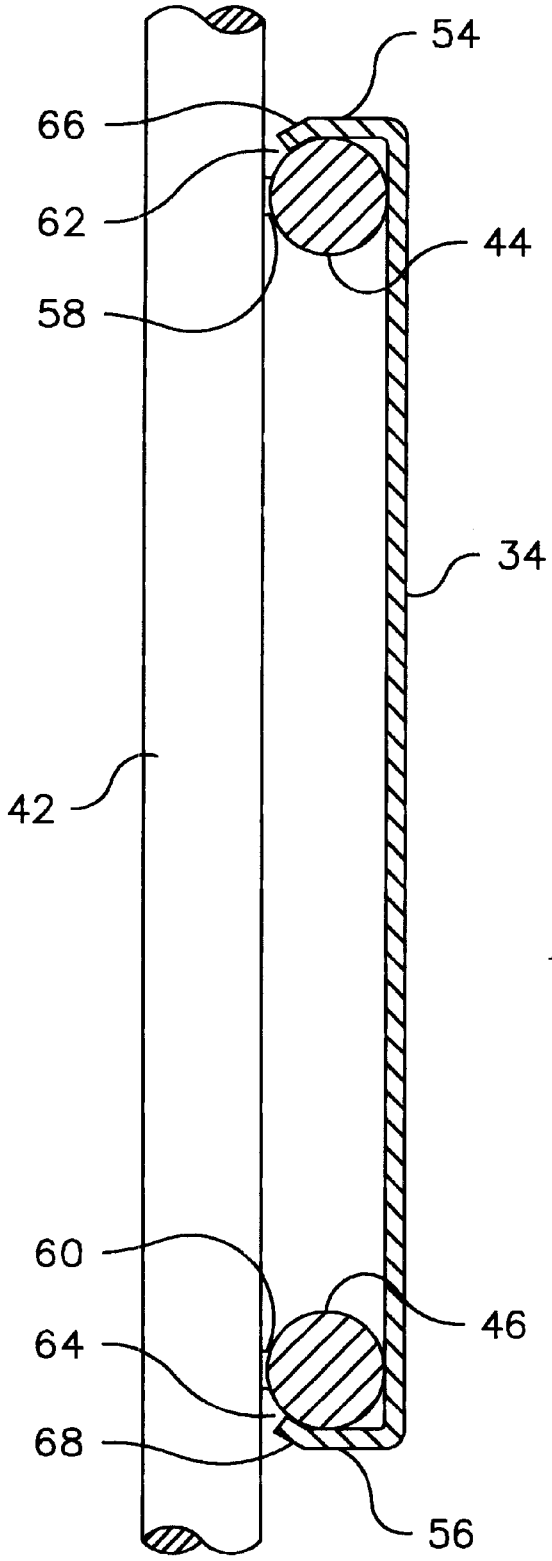
FIG. 4 is an enlarged sectional view of a portion of the merchandising display showing details of the engagement of a flange of a panel with a horizontal wire.

FIG. 4 shows in greater detail the manner in which the panel 34 is engaged with horizontal wires 44 and 46. The horizontal wires are secured to the vertical wires by welds 58 and 60. These welds are preferably produced by precision resistance welding, which minimizes weld build up at the locations at which the horizontal wires meet the vertical wires. Therefore, as shown in FIG. 4, clearances 62 and 64 are provided respectively above weld 58 and below weld 60 between the horizontal wires and the vertical wires. Flange 54 has an inwardly bent edge portion 66, which fits into clearance 62, and flange 56 has a similar inwardly bent edge portion 68, which fits into clearance 64. The panels have some resilience, and therefore, they can be snapped onto the wires, and held in place by virtue of the engagement of the inwardly bent edge portions 66 and 68 of the flanges with the horizontal wires. The panels remain firmly attached to the wires in normal use, but can be removed from the wire supports by the use of a suitable prying device.

FIG. 5 shows two panels 34 engaged with horizontal supporting wires. The upper flange of the lower panel 34 is engaged with the top of horizontal wire 48 and the lower flange of the upper panel 34 is engaged with the bottom of wire 46. These two flanges are separated from each other by a short distance to provide slot 36. Hook 52 of a shelf bracket 70 is an L-shaped hook, having a horizontal part 72 which extends through slot 36 and rests on the upper flange of the lower one of the two panels 34. A vertical part 74 of the L-shaped hook engages the rear of wire 46. The bracket also includes a sheet metal element 76 having a cross section in the shape of an inverted L. This element is welded to the horizontal part 72 of the bracket, and its vertical part engages the face of the lower one of the two panels 34. Thus, the bracket engages the support at three points: the top of the upper flange of the lower panel, the rear of wire 46, and the front face of the lower panel. Engagement at the first point supports the bracket against downward translation, and the engagement at the latter two points, supports the bracket against rotation.

As will be apparent from FIG. 5, the horizontal wires meet vertical wires 42 in an imaginary vertical plane. As shown in FIG. 4, the clearances provided above and below the welds allow the bent edges of the flanges of the panels to engage the horizontal wires in close proximity to the imaginary vertical plane and in such a way that the panels are prevented from disengagement from the wires in normal use.

FIG. 6 shows a support unit similar to unit 12 of FIG. 1 in cross-section, with plural panels 28 attached to the upper wires, and a single, large panel 32 spanning several pairs of horizontal wires. Panel 32 has an upper flange connected to wire 78, which is an upper wire of a first pair, and a lower flange connected to wire 80, which is a lower wire of a different pair. As will be apparent, a wide variety of panel arrangements can be utilized, and the configuration of the panels can be readily changed by removing panels from the wire grids and reattaching them at different locations.

FIG. 7 shows an alternative embodiment of the invention. In this embodiment, panels 82 are configured so that instead of embracing a pair of horizontal wires 84, a panel is provided with outwardly concave flanges 86 and 88 situated between the wires of the pair. In this embodiment, the horizontal wires are exposed, and the horizontal part 90 of a merchandise support bracket directly engages the top of a horizontal wire 84. Otherwise, the arrangement is similar to the arrangement in FIG. 5, and the panels can be easily snapped into place and removed.

Various modifications can be made to the merchandise display. For example, instead of being situated in a free-standing, portable unit, the wire grid can be permanently installed in a retail building, for example against or closely adjacent a permanent wall in a floor-to-ceiling arrangement.

Alternatively, instead of providing one-sided units in back-to-back relationship, a single, two-sided, free-standing unit having two, parallel, closely spaced wire grids can be provided. Although in most cases, the wires of the wire grid will meet one another in an imaginary vertical plane, other arrangements are possible. For example, the upright wires can be oblique or curved, and the transverse, panel-engaged brackets, and the panels which engage them, can be curved.

Although the panels are preferably light gauge, sheet steel panels, as an alternative, the panels can be formed of various other materials, for example, brass, stainless steel or plastics. The panels can also be formed with textured or plated surfaces. Perforations can be provided in the panels to accept pegs or other accessories, and clips can also be provided for engagement of the panels with the vertical wires.

It is also possible to form the panels in configurations other than the flat-faced-configuration shown. For example, the panels can be formed with horizontal ledges for displaying articles or for aesthetic purposes.

Finally, the flanges of the panels can have various configurations. For example, the flanges can be rounded to conform to the shapes of the horizontal wires with which they are engaged.

Still other modifications can be made to the embodiments of the merchandising display described herein, without departing from the scope of the invention, as defined by the following claims.

What is claimed is:

1. A merchandising display comprising:

a first set of wires disposed in parallel, spaced relationship to one another, said wires having front sides situated in an imaginary surface;

a second set of wires disposed in parallel, spaced relationship to one another, the wires of the second set having rear sides situated in said imaginary surface and being connected to, and supported by, the wires of the first set, the wires of the second set being disposed in adjacent pairs, with the wires of each pair being spaced from each other by a distance greater than the spacing between adjacent pairs; and a plurality of elongated panels having opposite long edges extending in their direction of elongation, the panels having front and rear faces, and flanges extending rearward from said edges, the flanges of each panel being removably engaged with the wires of the second set, and the long edges of adjacent panels being spaced from each other, whereby access slots are provided between the panels for receiving merchandise support brackets and the support brackets can be supported by wires of the second set.

2. A merchandising display in accordance with claim 1, wherein the flanges of each panel are removably engaged with the wires of a said pair.

3. A merchandising display in accordance with claim 1, wherein said panels are formed of plastics.

4. A merchandising display in accordance with claim 1, wherein said panels are formed of sheet metal.

5. A merchandising display in accordance with claim 1, wherein the wires of the second set are connected to the wires of the first set by welds at contact points in said imaginary surface.

6. A merchandising display in accordance with claim 5, wherein each flange has a bent edge and wherein a clearance is formed at each of said contact points between a part of a wire of the first set and a part of a wire of the second set, each bent edge extending into one of said clearances.

7. A merchandising display in accordance with claim 1, wherein the wires of the second set are connected to the wires of the first set at contact points in the imaginary surface, wherein each flange has a bent edge, and wherein a clearance is formed at each of said contact points between a part of a wire of the first set and a part of a wire of the second set, each bent edge extending into one of said clearances.

8. A merchandising display in accordance with claim 1, wherein the wires of the first set are vertical wires, and wherein the wires of the second set are horizontal wires.

9. A merchandising display in accordance with claim 1, wherein said imaginary surface is a plane.

* * * * *